US005090132A

United States Patent [19]

Kobayashi et al.

[11] Patent Number: 5,090,132

[45] Date of Patent: Feb. 25, 1992

[54] METHOD AND APPARATUS FOR FREEZE DRYING

[75] Inventors: Masakazu Kobayashi; Konomi Harashima, both of Tokyo, Japan

[73] Assignee: Kyowa Vacuum Engineering, Ltd., Tokyo, Japan

[21] Appl. No.: 521,309

[22] Filed: May 9, 1990

[30] Foreign Application Priority Data

May 12, 1989 [JP] Japan ..... 1-119559

[51] Int. Cl.[5] ..... F26B 5/06

[52] U.S. Cl. ..... 34/5; 34/92

[58] Field of Search ..... 34/5, 9, 92, 15, 60

[56] References Cited

U.S. PATENT DOCUMENTS 4,802,286 2/1989 Kobayashi et al. ..... 34/5 X

*Primary Examiner*—Henry A. Bennet

*Attorney, Agent, or Firm*—Fulbright & Jaworski

[57] ABSTRACT

A freeze drying apparatus comprises a heat-transfer medium container having heat-transfer medium inlet/-outlet pipes, a plurality of tubes extending through the heat-transfer medium container from its lower plate to upper plate, a lower space formed beneath the heat-transfer medium container and being in communication with the tubes and a product liquid inlet/outlet conduit, an openable bottom lid defining the bottom of the lower space, an upper space formed above the upper plate of the heat-transfer medium container, a trap chamber being in communication with the upper space, pressure regulation lid means operable to airtightly cover part of the tubes at their upper ends, and a pressure regulation conduit with pressure regulation valve operable to regulate pressure in the tubes covered with the pressure regulation lid means.

7 Claims, 11 Drawing Sheets

METHOD AND APPARATUS FOR FREEZE DRYING

BACKGROUND OF THE INVENTION

1. Field of the Invention

The present invention relates to freeze drying method and apparatus suitable for the treatment of material such as liquid solutions, emulsions, suspensions of solids in liquids, slurries and the like.

2. Description of the Prior Art

In a conventional freeze drying method for the material to be dried, there is employed a tray/shelf system. In this system, the material having been frozen and received in containers such as trays and the like is disposed on or between shelves in a vacuum chamber, from which shelves a certain amount of heat is supplied to such frozen material so that sublimation of at least one of constituents of the frozen material occurs. After completion of such sublimation, clean air or nitrogen gas is introduced into the vacuum chamber. Then, the material having been dried through such sublimation is taken out of the vacuum chamber together with the containers.

In such conventional method, a mass-produced product, for example, a coffee extract liquid is first concentrated and then frozen. The thus frozen coffee extract is granulated to have a particle-size of from 1 to 3 mm. After that, the trays are filled with the thus granulated coffee extract. As for another mass-produced product, for example, a drug liquid, the bulk drying thereof is hitherto employed. In such bulk drying, the drug liquid is pressed out in a fine spray directed to a liquid of "Freon 12" which is one of trade names of dichlorodifluoromethane ($CCl_2F_2$) so as to form a fine particle-size frozen matter with which the trays are filled. The above-mentioned conventional method will be hereinafter referred to as the prior art 1.

In another conventional freeze drying method for the liquid material to be dried, the material is first poured into the trays and then disposed on cooling shelves or disposed in a freezing chamber so that the material is frozen as is in cases of most bulk drying operations of the drugs and a few foods. Such another conventional freeze drying method will be hereinafter referred to as the prior art 2.

In any of the prior arts 1 and 2, the material to be dried is first spread on plate-like trays widely and thinly, and then subjected to a preliminary freezing operation and a freeze drying operation. After that, the trays are upset to collect the product. Consequently, in any case, it is necessary to handle a plurality of the trays each of which has a wide surface area, in a wide space by means of a complex handling mechanism of at the expense of considerable labors. In case that the material to be dried must be treated in a high-level hygienic environment, such treatment must be conducted in a bio-clean room.

Especially, in the prior art 2 in which the liquid material is first poured into the trays and then frozen in the trays, the material frozen in the trays can not be separated from the trays by simply upsetting the trays. Consequently, in this case, it is necessary to scrape the frozen material off the trays manually or by means of an automatic scraping mechanism. Such manual or automatic scraping operation of the material frozen in the trays makes the process of the prior art 2 complex.

These are disadvantages inherent in the prior arts 1 and 2.

In order to eliminate these disadvantages inherent in the prior arts 1 and 2 or the tray/shelf system, there has been provided another conventional freeze drying method as shown in U.S. Pat. No. 3,281,956 (prior art 3) and U.S. Pat. No. 3,264,745 (prior art 4), in which: a space defined between upright cylinders is filled with the liquid material being dried, and then the surfaces of such cylinders are cooled to form a desired-thickness frozen layer of the liquid material on each of the surfaces of the cylinders. After completion of formation of such frozen layer of the liquid material, the remaining part of the liquid material is removed from the space defined between the cylinders. After that, the frozen layer of the material is subjected to a vacuum environment while heated through the surfaces of the cylinders to obtain from the surfaces the heat required for sublimation, so that sublimation of at least one of constituents of the materials occurs. After completion of such sublimation, the layers of the material dried on the surfaces of the cylinders through such sublimation are scraped from the surfaces of the cylinders and collected by a product receiver disposed below the cylinders. The conventional method disclosed in the above U.S. Patents will be hereinafter referred to as the prior art 3. More particularly, in the prior art 3, a heat-transfer medium is circulated through the cylinders so that the liquid material received in the space defined between these cylinders are frozen in positions adjacent to the surfaces of the cylinders to form the desired-thickness frozen layers of the material in such positions. Then, the remaining part of the liquid material still not frozen in the space is removed from the space, and thereafter the frozen layers of the material is subjected to the vacuum environment while gradually heated by means of the heat-transfer medium circulated in the cylinders. The thus obtained product having been dried on the surfaces of the cylinders are scraped from the surfaces of the cylinders by means of a scraper which rests at a position above the cylinders and is driven downward by a threaded rod in such scraping operation. Thus scraped product or dried material is collected by the product receiver.

As described above, in the prior art 3, the layers of material frozen on the surfaces of the cylinders adhere to the surfaces of the cylinders. Consequently, in order to separate the frozen layers of the material from the cylinders, in the prior art 3, there is employed a scraping mechanism comprising a disk-like scraper having a plurality of circular holes each of which has a diameter slightly larger than an outer diameter of each of the cylinders. In the scraping operation of the frozen material or product, the cylinders pass through the circular holes of the disk-like scraper in a sliding manner so as to scrape the product off the surfaces of the cylinders. Consequently, due to clearances between the circular holes of the scraper and the cylinders, thin layers of the product or frozen material remain on the surfaces of the cylinders, while a metal powder is produced due to a slidable contact established between the surfaces of the cylinders and the scraper, both of which are made of metal. These are disadvantages inherent in the prior art 3.

On the other hand, further another conventional method for freeze drying is disclosed in the prior art 4, in which: a heat-transfer medium for the cooling purpose is circulated through an outer space defined between a plurality of upright cylinders filled with the material being dried, so that a frozen layer of the material is formed on an inner surface of each of the cylinders in contrast with the prior art 3 in which the frozen layer of the material is formed on an outer surface of each of the cylinders. In the prior art 4, there is described that: any scraping mechanism is not employed, and, therefore, in order to facilitate separation of the product or dried material from the inner surfaces of the cylinders, any of the cylinders must be straight in shape and must be free from any deformation even when the temperatures of the cylinders vary.

In the prior art 4, it is described that the product dried on the inner surfaces of the cylinders can be easily separated from the inner surfaces of the cylinders, and therefore any scraping mechanism is not employed. In general, the frozen material is slightly contracted when dried, so as to facilitate separation of the thus dried material from the inner surfaces of the cylinders. However, in most cases, depending on the properties of the material being dried and conditions of the freezing and drying operations, the material having been received in the cylinders in a liquid state and then frozen therein tends to adhere to the inner surfaces of the cylinders except that the material is an extremely dilute solution. As a result, it is not possible to completely separate the died material from the inner surfaces of the vertical cylinders, and, therefore, a part of the dried material rests on the inner surfaces of the cylinders. This is a defect inherent in the prior art 4.

In any of the prior arts 3 and 4, such remaining part of the dried material resting on the surfaces of the cylinders is subjected to the following cycle of the freeze drying operation of the liquid material, and thereafter repeatedly subjected to the further following cycles in the same manner. If the liquid material to be received in the cylinders during the next cycle of the operation is heated and the surfaces of the cylinders carrying the remaining part of the dried material are also heated, it is possible to dissolve the remaining part of the dried material adhering to the surface of the cylinders so as to remove the same from the surfaces of the cylinders. However, in any of the prior arts 3 and 4, heating of the liquid material deteriorates the quality of the product.

In this connection, in the following cycle of the freeze drying operation, in case that the cylinders are kept at a temperature below 0° C. at their surfaces while filled with the liquid material having a temperature of approximately 0° C., the remaining part of the dried material formed on the surfaces of the cylinders during the previous cycle of the freeze drying operation remains as it is in the following cycle of the operation. The more the material is concentrated, the more the material adheres to the surfaces of the cylinders. This is another defect inherent in the prior arts 3 and 4.

Under the circumstances, a countermeasure as disclosed in U.S. Pat. No. 4,802,286 to the present inventors (prior art 5) has been proposed to eliminate the drawbacks of the aforementioned prior arts 3 and 4. The prior art 5 solves the problem of the prior arts 3 and 4, that is, adherence of the dried material to the cylinder surface and especially, the apparatus of upright surface construction as illustrated in FIGS. 3, 4, . . . 7 and 8 of the prior art 5 succeed in continuously conducting all processes for the material in an air tightly sealed system.

However, with the apparatus of the prior art 5, another disadvantage of the prior arts 3 and 4, that is, the problem that part of product liquid poured into the drying chamber, not being small in amount to measure, for example, 60 to 30%, is not subjected to the freeze drying operation but is drained in the form of liquid is still remains unsolved.

As a countermeasure against this problem, the prior art 5 describes a method shown in U.S. Pat. No. 4,802,286, according to which method a great number N of drying chambers are juxtaposed and individual drying chambers are sequentially operated at an equal time delay of $\nu/N$ (hr) when cycle time required for freeze drying is $\theta$ (hr) whereby liquid drained from the preceding drying chamber is charged into the succeeding drying chamber together with new product liquid so that the N drying chambers are reiteratively and circulatively used during continuous operation period. The system shown in FIG. 7 of the prior art 5 is suited for only a product liquid not prone to quality deterioration and a product for which a large volume of same material is processed through one cycle of continuous processing. But, in order to decrease the ultimate drain amount sufficiently as compared to the yield obtained during continuous operation, the number of freeze drying operations over the period for one cycle of continuous operation, that is, (the number of drying chambers N) X (the number of reiterations n) must be set to about 50 ($nN=50$). In general, the cycle time for freeze drying $\theta$ is 10 to 20 hours or more and even for the number of freeze drying chambers being $N=5$, the product material liquid stays in the system for a time amounting up to about 100 to 200 or more hours. In order to reduce the stay time, the number of drying chambers must be increased further. Considering biologically original material and drug material, many kinds of materials, even when maintained at a low temperature of about 0° C., are desired to be transferred to the freeze drying process within a few hours to about 10 hours for the sake of preventing quality deterioration, and in many cases, products are handled in unit of lot of small volume and therefore quality control must be conducted lot by lot and products of one lot are not permitted to mix in another lot. As far as such products are concerned, the disadvantage of the prior arts 3 and 4 that substantial part, 60 to 30%, of product material liquid charged into the freeze drying chamber is not processed and is inevitably drained is not solved by the system shown in FIG. 7 of the prior art 5.

SUMMARY OF THE INVENTION

The present invention intends to solve the aforementioned drawbacks of the prior arts and especially, has for its object to sufficiently reduce the amount of product liquid which is removed in the form of material liquid drain in the apparatus shown in the prior art 4 and FIGS. 3 and 4 of the prior art 5. Conventionally, in order that product material liquid charged into a plurality of upright tubes is frozen to form frozen layers of a desired thickness on the inner cylindrical surfaces of the tubes while leaving behind, in the radially central portion of each tube, a space through which sublimated water vapor can flow, it is necessary that a substantial part of the product material liquid, 60 to 30% (equal to the volume to be left behind), be drained from the tubes and processed in the next cycle or another drying chamber. The present invention eliminates the above disadvantages to ensure that most of the product liquid poured into the drying chamber is formed into desired frozen layers in the drying chamber and the drain amount, for which a radially central space is left behind in each tube, can be reduced.

Fundamentally, to accomplish the above object according to the invention, in a freeze drying apparatus having a drying chamber including an upright cylindrical heat-transfer medium container having heat-transfer medium inlet/outlet pipes, a plurality of upright tubes extending through the container from its lower plate to upper plate, a lower space formed beneath the lower plate of the heat-transfer medium container and being in communication with the interior of the tubes and with a product liquid inlet/outlet conduit, and openable bottom lid defining the bottom of the lower space, and upper space formed above the upper plate of the heat-transfer medium container and being in communication with the interior of the tubes, and a trap chamber provided with a first pressure regulation valve and being in communication with the upper space through a sluice valve or directly, the tubes are sorted into a second set of a desired number of tube or tubes, a pressure regulation lid is engageably provided to the upper end of each tube of the second set to airtightly close the upper end, and a pressure regulation conduit is provided which has a second pressure regulation valve adapted to regulate pressure in the tube covered with the pressure regulation lid independently of pressure in the upper space.

In the apparatus of the invention having the construction described above, the pressure regulation lid is precedently brought into intimate contact with the surface of the upper plate surrounding the upper end openings of tubes of the second tube set. Then, product material liquid is charged into tubes from the conduit through the lower space by an amount corresponding to the sum of an internal volume of the first tube set without pressure regulation lid and a volume of the lower space, the liquid level of the product material liquid rises beyond the surface of the lower plate disposed at the lower ends of the tubes so that gas in the second tube set is airtightly confined. As the charging of the product material liquid proceeds, the liquid level further increases to compress the gas, with the result that pressure P2 in the second tube set exceeds pressure P1 in the first tube set. Consequently, most of the charged liquid fills the first tube set, providing the liquid level in the second tube set which is lower than the liquid level in the first tube set by a liquid column corresponding to a pressure difference (Pa-Pl) $\rho gh$ where $\rho$ is density of the liquid, g is acceleration of gravity and h is height of the liquid column. Subsequently, the upper space in the drying chamber is evacuated through the first pressure regulation valve or the pressure in the second tube set is further increased to lower the liquid level in the second tube set until the liquid level is substantially flush with the surface of the lower plate. With the liquid level in the second tube set kept to be substantially flush with the lower end of the second tube set, the inner surfaces of all the tubes are refrigerated sufficiently or they have already been refrigerated sufficiently, so that the charged product liquid is frozen to form frozen layers only on the inner circumferential surfaces of tubes of the first tube set without pressure regulation lid and on the surface of the lower plate. When the total volume of unfrozen parts in radially central portions of the tubes of the first tube set becomes equal to or smaller than the internal volume of the second tube set, the pressure in the upper space in the drying chamber is returned to 1 atm and at the same time the pressure in the second tube set is reduced through the second pressure regulation valve, or the pressure in the upper space in the drying chamber is increased, so that unfrozen part of the product liquid in the first tube set is transferred to the second tube set. With the liquid level of unfrozen part remaining in the second tube set kept to be substantially flush with the lower end of the second tube set, the inner circumferential surfaces of all the tubes are kept to be refrigerated, so that frozen layers may grow only on the inner surfaces of tubes of the second tube set and on the surface of lower plate. Preferably, the lower end of the second tube set is designed to be slightly lower than the surface of the lower plate flush with the lower end of the first tube set and the liquid level is flush with the lower end of the second tube set to separate frozen layers, which have already been formed on the lower plate surface, from the liquid level flush with the lower end of the second tube set, thereby ensuring that the frozen layer, which have already been formed on the lower plate surface during the formation of the frozen layers on the inner surfaces of tubes of the first tube set, can be prevented from growing further. When frozen layers having the same thickness as that of the frozen layers in the first tube set are also formed on the inner surfaces of tubes of the second tube set, the remaining part of product liquid is discharged to the outside through the conduit. In this manner, the frozen layers of the desired thickness can be formed on the inner surfaces of all the tubes and on the lower plate surface, leaving behind spaces necessary for water vapor to flow in all the tubes and besides, "the drain amount from all tubes" inevitable in the apparatus shown in the prior art 4 or in FIGS. 3 and 4 of the prior art 5 can be reduced to "the drain amount from the second tube set" in accordance with teachings of the present invention.

In case where the number of tubes of the second tube set is $\frac{1}{4}$ of the total number of tubes, the product liquid is charged by an amount sufficient to fill the first tube set having the number of tubes equal to $\frac{3}{4}$ of the total number and the lower space, $\frac{1}{3}$ of the amount of product liquid filling the first tube set is frozen to form frozen layers, the remaining part of product liquid is transferred to the second tube set to form similar frozen layers therein and the remaining product liquid is discharged, the drain amount, that is, the amount of liquid which is charged but is not processed, can be reduced to $\frac{1}{4}$ of the drain amount in the same type of prior art apparatus.

In an embodiment of the invention, tubes of the second tube set with pressure regulation lid are further sorted into a plurality of tube sets. In this case, the number of tubes of individual tube sets is sequentially reduced in substantially geometeical series relationship, beginning with the maximum of the first tube set without pressure regulation lid and ending in the minimum of the final tube set with pressure regulation lid.

In another embodiment of the invention, respective tubes of the tube set with pressure regulation lid are associated with independent pressure regulation lids respectively connected with pressure regulation conduits provided with pressure regulation valves.

The lower end of the tube set having the minimum number of tubes is located at the lowermost level, the lower end of the tube set having the maximum number of tubes is located at the uppermost level, and the lower ends of the intermediate tube sets are located at levels which gradually rise from the lowermost level to the uppermost level.

With the lengths of the respective tube sets changed in the manner described as above, it is possible to prevent the frozen layer formed on the lower plate surface common to the respective tube sets from growing to have a thickness larger than that of the frozen layer formed on the inner surface of the tube. If the lower ends of the individual tube sets are all flush with the lower plate surface, the lower plate surface is constantly immersed in product liquid throughout sequential transfer of the product liquid from the first tube set to the final tube set and the frozen layer on the lower plate surface is liable to grow excessively. However, by employing the disposition wherein a tube set having a smaller number of tubes is disposed close to the liquid conduit and the bottom lid defining the bottom of the lower space is inclined downwards toward the liquid conduit, the liquid level in the lower space decreases as the product liquid transfers to tube sets of smaller numbers of tubes and the frozen layer on the lower plate surface deviates from the product liquid. In addition to the above advantages, the drain amount after formation of the frozen layer in the final tube set can be reduced to advantage. To explain, as unfrozen part of liquid is sequentially transferred from the first tube set to the final tube set, part of the unfrozen liquid in the lower space is sequentially sucked into downstream tube sets. Since the lower end of the final tube set is flush with the lowermost position of the downwardly inclining bottom lid, the amount of product liquid remaining in the lower space and ultimately drained is very small.

DESCRIPTION OF THE PREFERRED EMBODIMENTS

Figure 1:
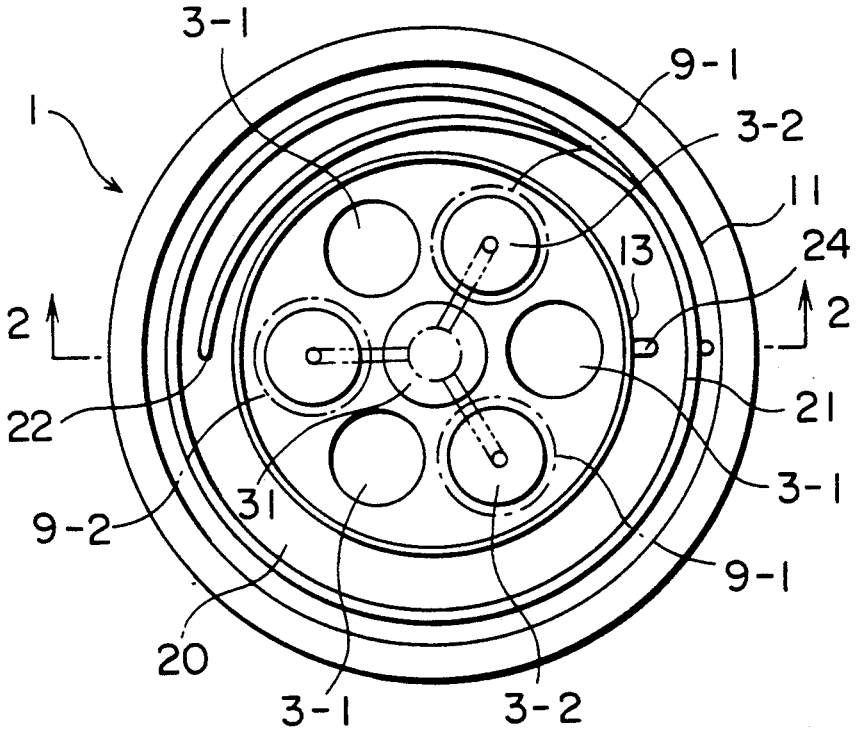
FIG. 1 is a plan view of an embodiment of a freeze drying apparatus of the invention as seen with a cover removed.
Figure 2:
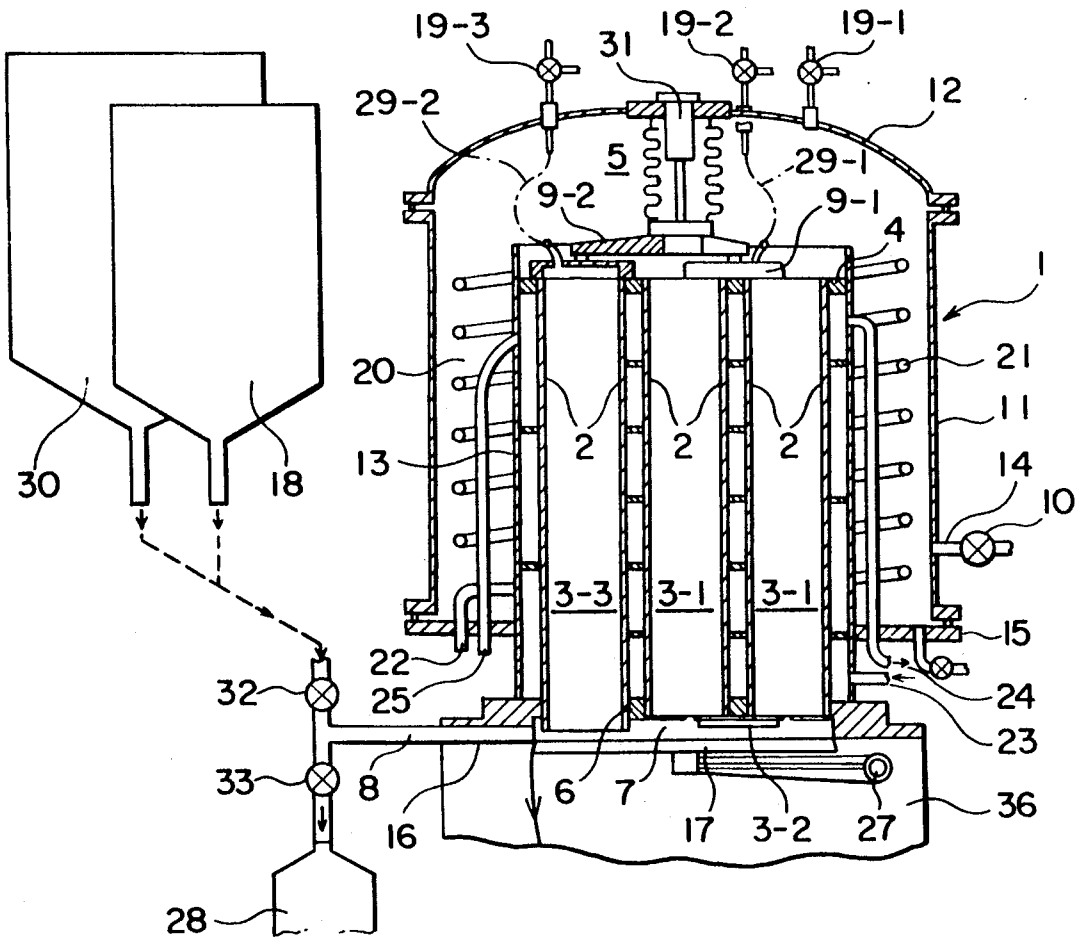
FIG. 2 is a sectional view taken on the line 2—2 of FIG. 1 and seen in the direction of arrow.

Referring now to FIGS. 1 and 2 illustrating an embodiment of the invention, reference numeral 1 designates a drying chamber having a casing 11, a cover 12 detachably mounted to the casing and a bottom plate 15.

Disposed inside the drying chamber 1 is a hollow, cylindrical heat-transfer medium container 13 having upper and lower ends which are mounted with an upper plate 4 and a lower plate 6, respectively. Disposed between the upper and lower plates 4 and 6 are first to third sets of tubes 3-1, 3-2 and 3-3. The number of tubes belonging to the respective sets decreases sequentially in geometrical series relationship, measuring 4 for the first tube set 3-1, 2 for the second tube set 3-2 and 1 for the third tube set 3-3. Upper and lower ends of each tube are opened. The third tube set 3-3 having the minimum number of tubes has its lower end which extends until the lowermost level, the first tube set 3-1 having the maximum number of tubes has its lower end positioned at the uppermost level which is substantially flush with the surface of the lower plate 6, and the second tube set 3-2 having the medium number of tubes has its lower end which extends until the middle of the uppermost and lowermost levels. The inner surface of each tube of the respective sets 3-1, 3-2 and 3-3 is formed into a refrigerating/heating surface 2. The cylindrical wall of the heat-transfer medium container 13 is connected, at its upper portion, with a heat-transfer medium outlet pipe 24 and, at its lower portion, with a heat-transfer inlet pipe 23.

Connected to the casing 11 of the drying chamber 1 is a conduit 14 having a pressure regulation valve 10 connected to a vacuum pump not shown. A trap chamber 20 inside the casing 11 surrounds the container 13. Within the trap chamber 20, a helical vapor trap 20 is supported, having opposite ends which go beyond the bottom plate 15 to terminate in refrigerant or heat-transfer medium inlet pipe 22 and outlet pipe 25, respectively. The trap chamber 20 is in communication with an upper space 5 which is above the container 13 and the top cover 12 defining the upper space 5 is connected with a conduit having a first pressure regulation valve 19-1 in the form of a cross valve.

Below the lower plate 6 of the heat-transfer medium container 13, a lower space 7 is defined by a cylindrical wall 16. The space 7 can be opened or closed by an openable bottom lid 17 which is pivotally mounted on a pivot 27 and inclined downwardly toward a liquid charge/discharge conduit 8. The liquid charge/discharge conduit 8 extends from the cylindrical wall 16 and outside the wall 16, it branches to two branch conduits of which one is connected to a liquid supply tank 18 and a water supply tank 30 through a liquid charge valve 32 and the other is connected to a liquid receiving tank 28 through a liquid discharge valve 33. The water supply tank 30 may be omitted if so desired. The single liquid charge/discharge conduit 8 exemplified herein is used in common for liquid charge and discharge but it may be replaced with a pair of conduits which are respectively dedicated to liquid charge and liquid discharge.

The above construction of this embodiment is totally the same as that of the apparatus disclosed in U.S. Pat. No. 4,802,286 previously described as prior art.

The present invention features a construction to be described below.

Mounted to the cover 12 of the drying chamber 1 are a drive member 31 and first and second pressure regulation lids 9-1 and 9-2 driven vertically by the drive member. The first pressure regulation lids 9-1 are supported above the tubes of the second set 3-2 within the upper space 5. Similarly, the second pressure regulation lid 9-2 is supported above the tube of the third set 3-3 within the upper space 5. When driven downwards by means of the drive member 31, these lids airtightly close upper end openings of the tubes of the second and third sets 9-2 and 9-2. The first and second pressure regulation lids 9-1 and 9-2 are connected to tips of first and second pressure regulation conduits 29-1 and 29-2 which are led to the outside of the cover 12 so as to be connected to a source of clean, dried atmospheric air or nitrogen gas, not shown, or a vacuum pump not shown.

The apparatus having the construction described above is operated in a manner to be described below with reference to FIGS. 3 through 9. For convenience of explanation, in the illustration of these Figures, separate drive members 31 are provided in association with the first and second pressure regulation conduits 29-1 and 29-2 and these conduits are driven vertically by means of the corresponding drive members.

In the following description, P1, P2 and P3 denote pressure values in the tubes of the first to third tube sets 3-1, 3-2 and 3-3, respectively, Pa denotes atmospheric pressure, $\rho$ denotes density of liquid, g denotes acceleration of gravity and h1, h2 and h3 denote heights of liquid columns in the tubes of the first to third tube sets 3-1, 3-2 and 3-3, respectively.

(1) A process for preventing the material of product remaining after drying from adhering to the refrigerating/heating surface 2 is first carried out in which the drive members 31 are actuated to move the pressure regulation lids 9-1 and 9-2 upwards, thereby separating them from the upper plate 4 and under this condition, the refrigerating/heating surfaces 2 of all tubes of the first to third tube sets 3-1 to 3-3 are pre-refrigerated and clean water is poured into all of the tubes to form ice films on their refrigerating/heating surfaces 2.

Figure 3:
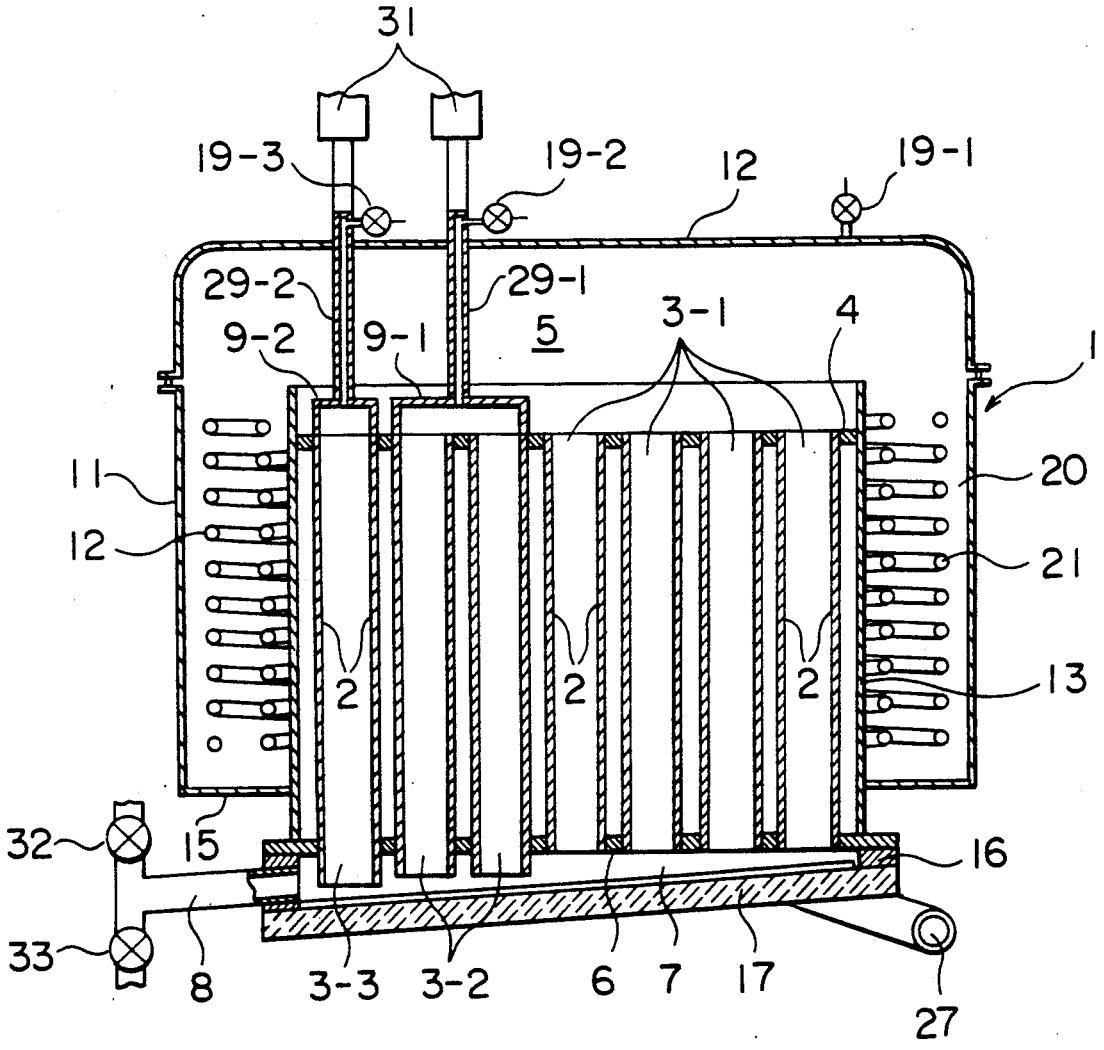
FIG. 3 is a sectional view showing the state in which second and third tube sets are closed by pressure regulation lids in the FIG. 1 embodiment.

(2) Subsequently, the drive members 31 are actuated to move the pressure regulation lids 9-1 and 9-2 downwards, thereby bringing them into intimate contact with the upper plate 4 as shown in FIG. 3, and second and third pressure regulation valves 19-2 and 19-3 are closed and the first pressure regulation valve 19-1 is opened so that atmospheric pressure Pa prevails in the entire space inside the drying chamber 1. Accordingly, there results $P1=P2=P3=Pa$.

Figure 4:
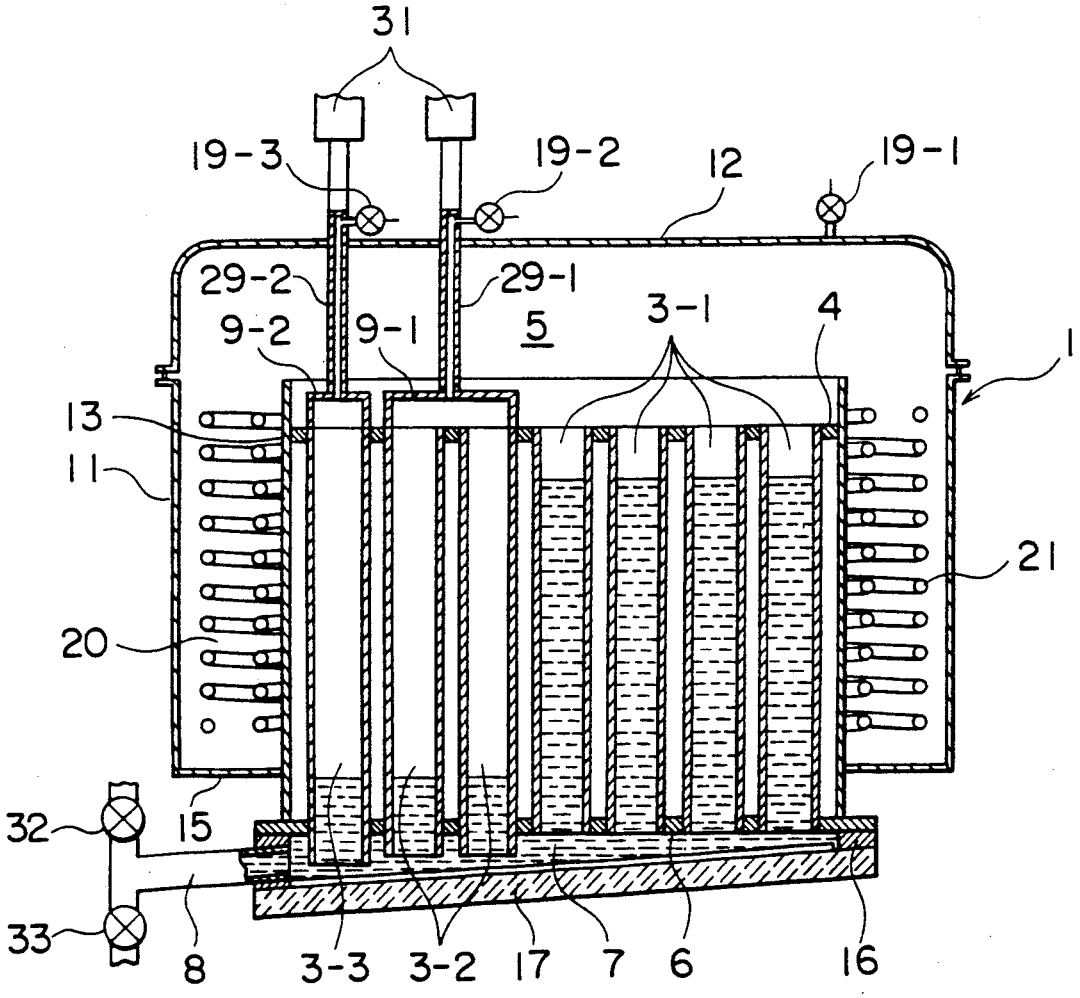
FIG. 4 is a similar sectional view showing the state in which product liquid is charged into a first tube set in the FIG. 1 embodiment.

(3) Subsequently, with reference to FIG. 4, liquid of product is charged into the drying chamber 1 through the conduit 8 by a volume equal to the sum of the total volume of the first tube set 3-1 and a volume of the lower space 7. During charging of the product liquid, as the liquid level of the thus charged product liquid rises beyond the lower plate 6, the product liquid is permitted to freely enter the tubes of the first set 3-1 having the opened upper ends but the product liquid entering the tubes of the second and third sets 3-2 and 3-3 stops rising at a liquid level h' far lower than a liquid level h1' for the first tube set 3-1 because air in the tubes of the second and third sets 3-2 and 3-3 having the upper end openings now airtightly closed by the pressure regulation lids 9-1 and 9-2 is compressed as the liquid level rises. In this case, $P2=P3=P1+\rho g(h1'-h')$, $h1=h1'$, $h2=h3=h'$ and $P1=Pa$ stand.

(4) Subsequently, with reference to FIG. 5, a vacuum pump connected to the first pressure regulation valve 19-1 is operated to reduce the pressure in the drying chamber 1. Then, the liquid level in the first tube set 3-1 is further raised and the liquid level in the second and third tube sets 3-2 and 3-3 is caused to decrease. By regulating the pressure in the drying chamber 1 such that the liquid level in the second and third tube sets is substantially flush with the surface of the lower plate 6, $P2=P3=Pa$, $P1=Pa-\rho gh$, $h1=H$ and $h2=h3=0$ stand.

Figure 6:
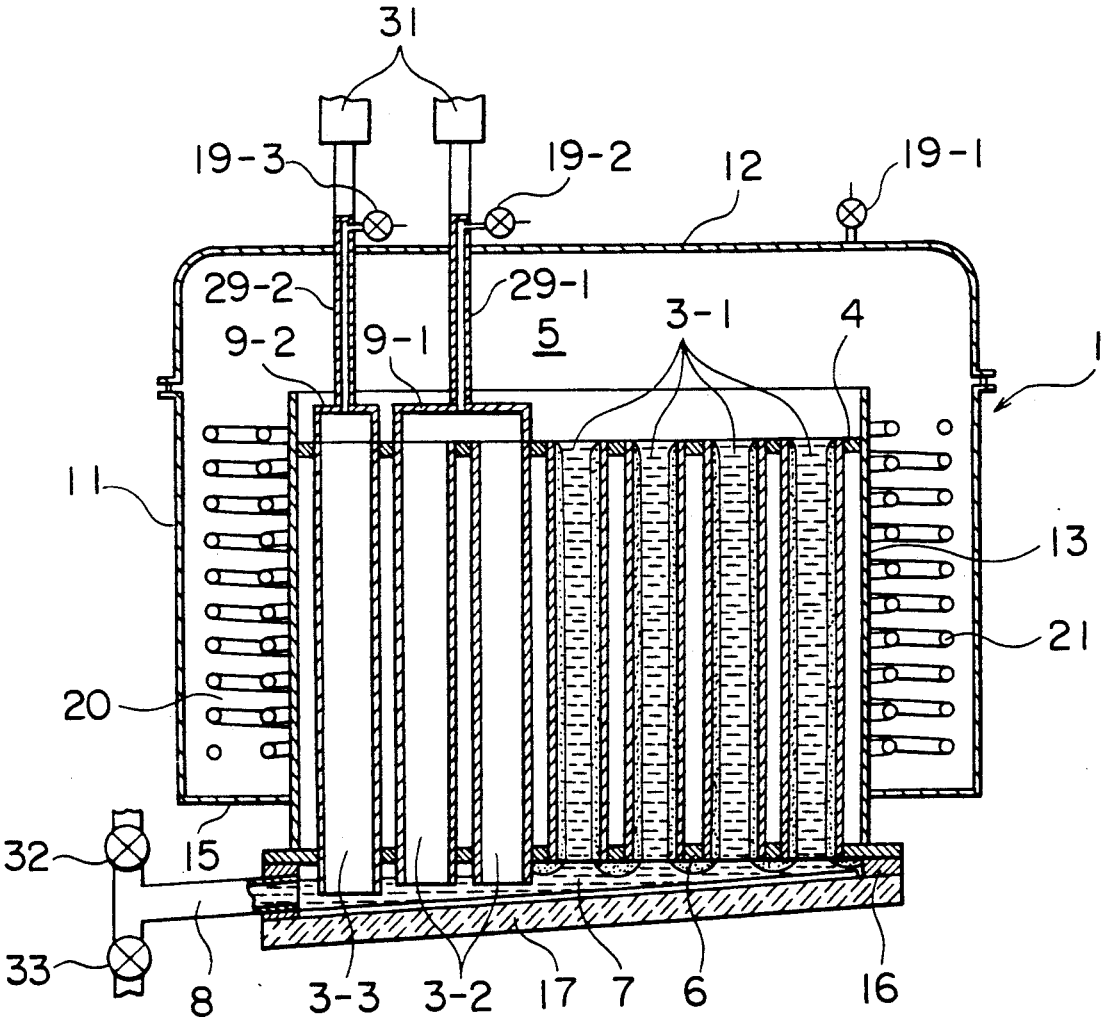
FIG. 6 is a similar sectional view showing the state in which frozen layers are formed on the inner surfaces of tubes of the first tube set under the condition of FIG. 5.

(5) Subsequently, with reference to FIG. 6, the heat-transfer medium container 13 is pre-refrigerated sufficiently of is refrigerated after this condition has been set up, with the result that part of the product liquid present in the first tube set 3-1 grows along only the inner circumferential surface of each tube of the first set 3-1 and surface of the lower plate 6 to form a frozen layer of a predetermined thickness, leaving behind a necessary liquid column in the radially central portion of each tube. In this embodiment, the volume of the unfrozen product liquid in the radially central portion of the tube is so set as to be half the volume of each tube of the first set 3-1. Since the product liquid turns into the frozen layer by expanding its volume, the liquid level in the first tube set 3-1 rises as the growth of the frozen layer proceeds. A rise in the liquid level is detected by a liquid level sensor not shown which in turn produces a signal representative of a raised amount $\Delta H$. On the basis of the raised amount, the thickness of the frozen layer can be measured. In this case, $P2=P==Pa$, $P1=Pa-\rho gHf$, $h1=Hf$, $h2=h3=0$ and $\Delta H=Hf-H$ stand. On the other hand, the procedure proceeds to the next process in accordance with a program in which the correlation between the temperature at the refrigerating/heating surface 2 and the time is set.

Figure 7:
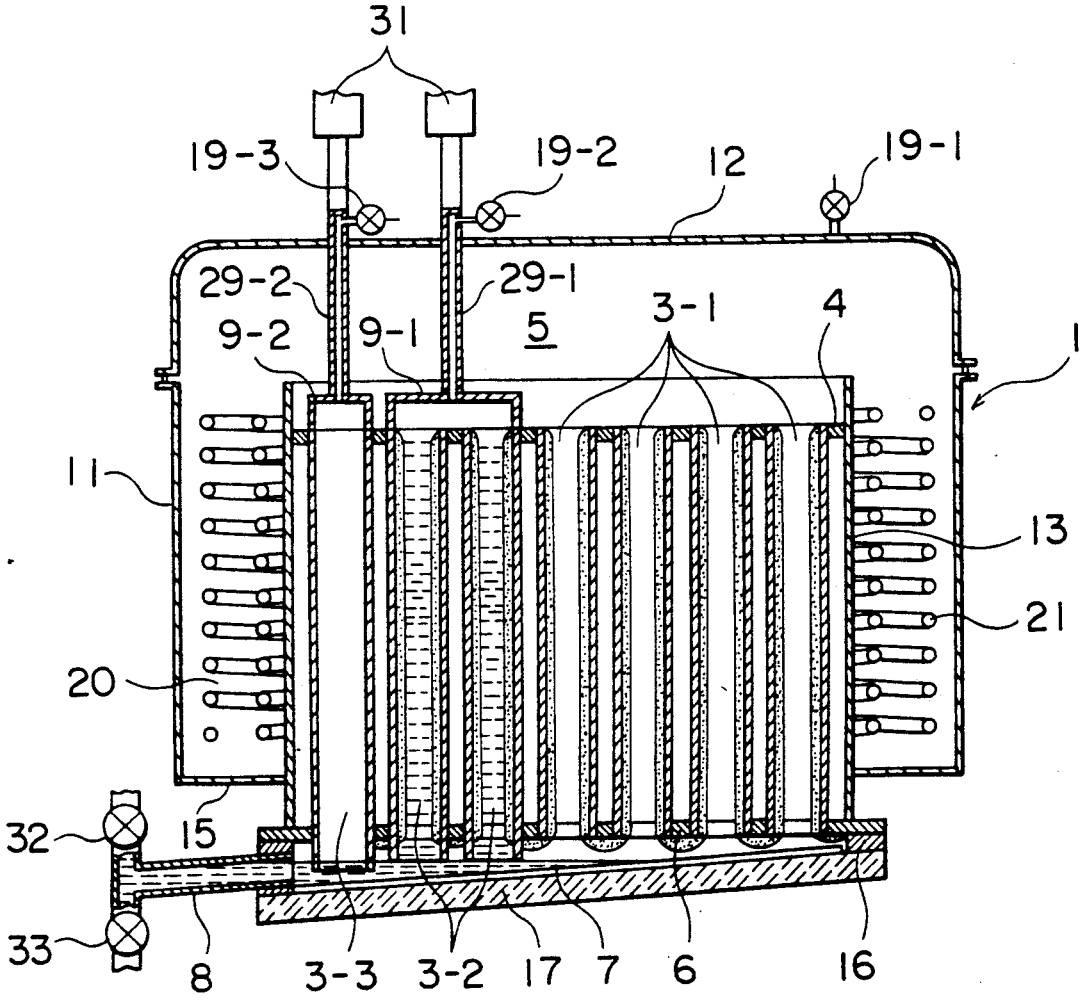
FIG. 7 is a similar sectional view showing the state in which the second tube set takes a similar condition to that of the first tube set shown in FIG. 6 so that unfrozen part of product liquid is discharged from the first tube set.

(6) Subsequently, with reference to FIG. 7, the first and third pressure regulation valves 19-1 and 19-3 are operated to maintain the pressure in the upper space 5 inside the drying chamber 1, the pressure P1 in the first tube set 3-1 and the pressure P3 in the third tube set 3-3 at the atmospheric pressure Pa and concurrently therewith, the second pressure regulation valve 19-2 is operated to reduce the pressure P2 in the second tube set 3-2.

Under this condition, the unfrozen liquid parts or columns in the first tube set 3-1 are sucked into the second tube set 3-2 and the liquid level in the first and third tube sets 3-1 and 3-3 is lowered until it becomes substantially flush with the surface of the lower plate 6. At that time, the unfrozen liquid parts having the volume which is half that of the first tube set 3-1 are transferred to the second tube set 3-2. While maintaining the liquid level in the first and third tube sets 3-1 and 3-3 at the aforementioned level, refrigeration of the refrigerating/heating surface 2 continues until a predetermined thickness of the frozen layer is detected and thereafter the procedure proceeds to the next process. In this case, $P1=P3=Ps$, $P2=Pa-\rho gHf$, $h2=Hf$ and $h1=h3=0$ stand.

Figure 8:
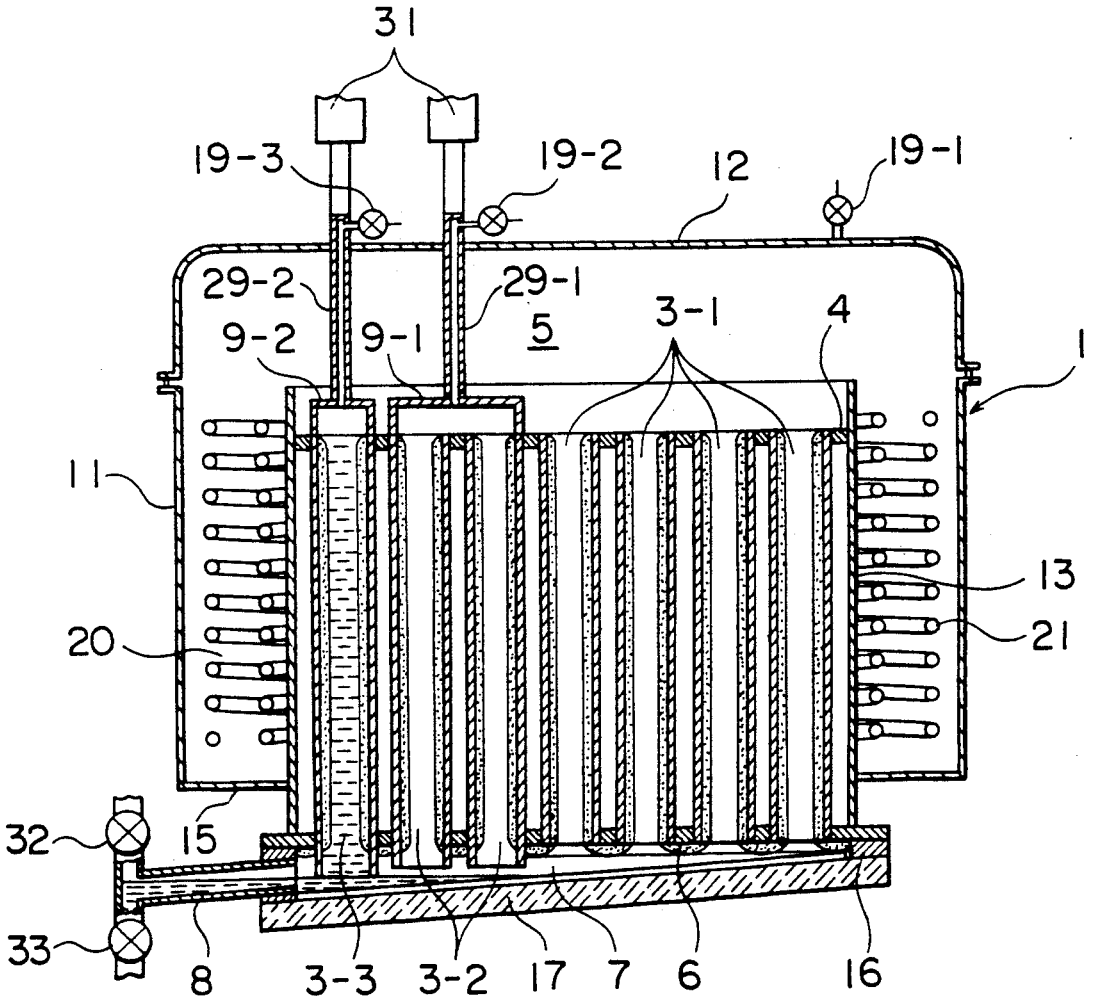
FIG. 8 is a similar sectional view showing the state in which the third tube set takes a similar condition to that of the first and second tube sets shown in FIG. 7 so that unfrozen part of product liquid is discharged from both the first and second tube sets.

(7) Subsequently, with reference to FIG. 8, the pressure regulation valves 19-1, 19-2 and 19-3 are operated to adjust the pressure P1 in the first tube set 3-1, the pressure P2 in the second tube set 3-2 and the column heights h1, h2 and h3 such that $P1=P2=Pa$, $P3=Pa-\rho gHf$, $h3=Hf$ and $h2=h1=0$ stand. Under this condition, the unfrozen liquid parts in the second tube set 3-2 are all sucked into the third tube set 3-3. Then, refrigeration of the refrigerating/heating surface 2 continues until a frozen layer of a predetermined thickness is formed on the inner circumferential surface of the tube of the third set 3-3. During this process, the predetermined thickness of the frozen layers in the first and second tube sets 3-1 and 3-2 are maintained. Then, the thickness of the frozen layer in the third tube set is detected and the procedure proceeds to the next process.

Figure 9:
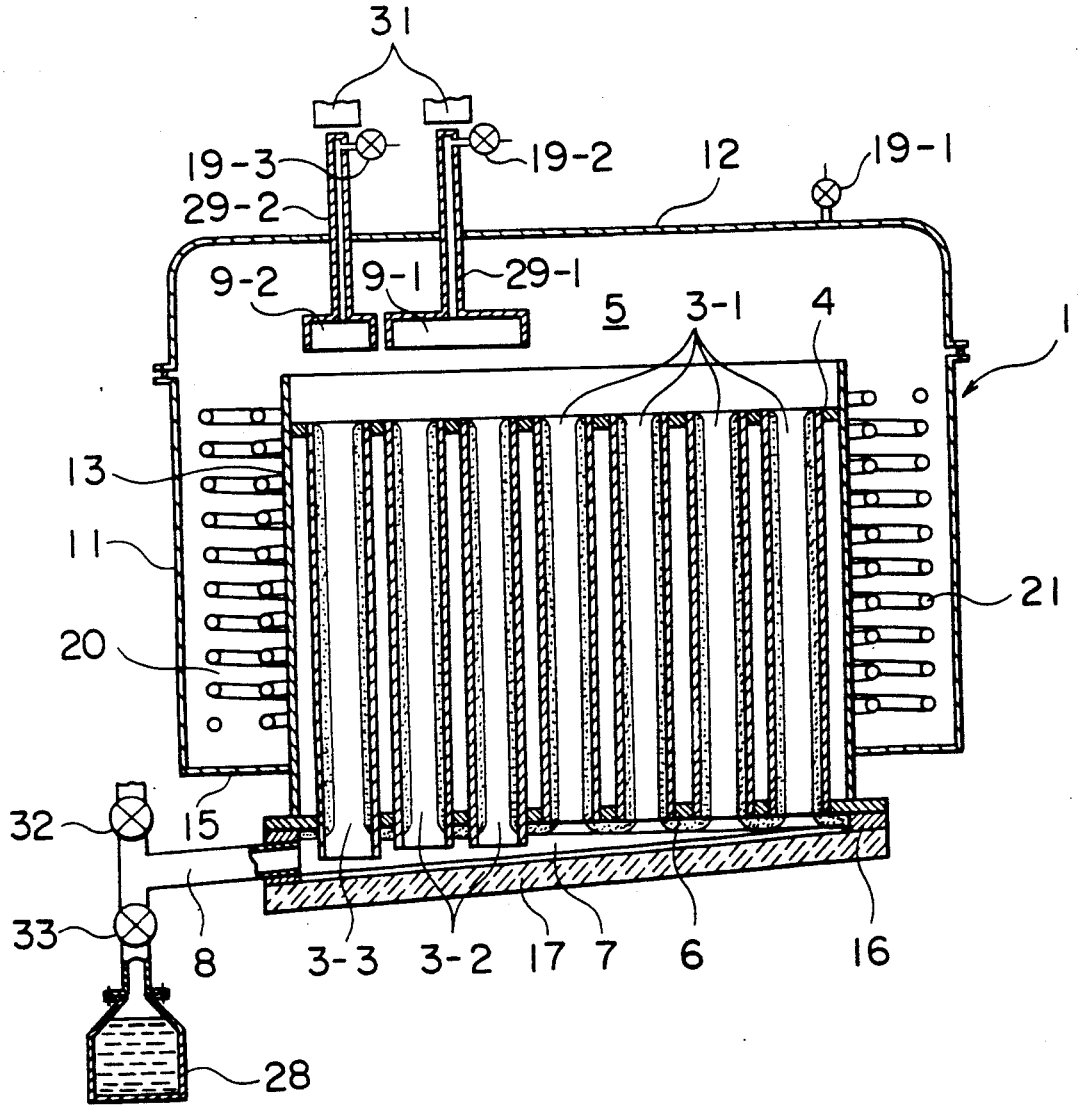
FIG. 9 is a similar sectional view showing the state in which unfrozen part of product liquid is discharged from all of the tube sets.

(8) Subsequently, with reference to FIG. 9, the liquid discharge valve 33 is opened so that unfrozen liquid remaining in the apparatus is discharged into the liquid receiving tank 28, and at the same time the first and second pressure regulation lids 9-1 and 9-2 are moved upwards by the drive members 31 until a position at which these lids will not prevent flows of sublimated water vapor from rising through the radially central space of all of the tube sets 3-1, 3-2 and 3-3 and moving to the vapor trap 20 through the upper space in the next freeze drying process.

(9) Finally, the entire space in the drying chamber 1 is maintained at vacuum pressure necessary for freeze drying while the refrigerating/heating surface 2 is adjusted to a temperature at which proper sublimation latent heat is supplied to the frozen layer. Under this condition, the freeze drying operation proceeds. In response to a signal indicative of completion of the freeze drying operation, the bottom lid 17 is opened so that the product is collected through a hopper 36 to a product tank.

In the foregoing embodiment, $\frac{1}{4}$ of the total number of tubes may be grouped into the second tube set 3-2 and $\frac{3}{4}$ of the total number of tubes or the remaining tubes may be grouped into the first tube set 3-1. In this case, liquid is charged by an amount sufficient to fill up the first tube set 3-1 and the lower space 7, and $\frac{1}{3}$ of the amount of the product liquid in the first tube set 3-1 is first frozen to form frozen layers. Thereafter, the remaining liquid is transferred to the second tube set 3-2 and similar frozen layers are formed in the second tube set 3-2. Subsequently, the remaining liquid is drained. In this manner, the drain amount can be reduced to $\frac{1}{4}$ of that in this type of conventional apparatus.

Figure 10:
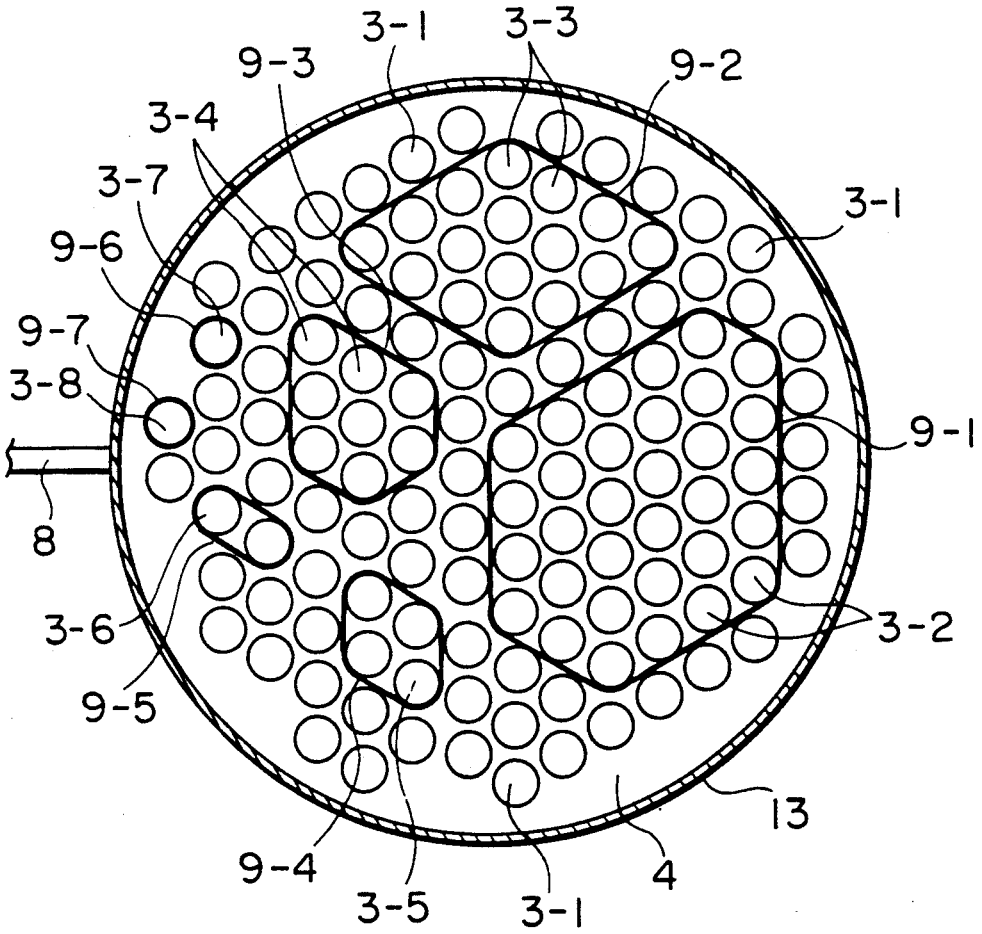
FIG. 10 is a fragmentary crosssectional vie showing the essential part of another embodiment of the invention.

The foregoing embodiment has been described by way of the fundamental construction of the present invention. By using the fundamental construction reiteratively, the amount of liquid once poured into the freeze drying chamber but unprocessed, that is, the drain amount can further be reduced. A second embodiment to this effect will be described with reference to FIG. 10.

The total number of tubes is 127 which is sorted into a first set of 64 tubes 3-1 without pressure regulation lid, a second set of 32 tubes 3-2 with pressure regulation lids, a third set of 16 tubes 3-3 with pressure regulation lids, and a fourth set of 8 tubes 3-4, a fifth set of 4 tubes 3-5, a sixth set of 2 tubes 3-6, a seventh set of 1 tube 3-7 and an eighth set of 1 tube 3-8, the fourth to eighth tube sets 3-4 to 3-8 having pressure regulation lids. In accordance with the aforementioned fundamental construction, half the amount of product liquid in the first tube set is first turned into frozen layers and then pressure P2 in the second tube set is kept to be lower than pressure commonly prevailing in the remaining tube sets and measuring P1=P3=P4=P5=P6=P7, so that the remaining unfrozen liquid in the first tube set is transferred to the second tube set and then frozen layers are formed in the second tube set. The above procedure is repeated to sequentially transfer the remaining part of liquid to the third, fourth, fifth, sixth and seventh tube sets. The final frozen layer is formed in the seventh tube set and the remaining part of liquid in this tube set is drained to the outside of the freeze drying chamber. In this manner, frozen layers are formed in the 127 tubes and part of liquid remaining only in the seventh tube set is drained, whereby 127/128 of the amount of charged liquid undergoes the freeze drying operation and the drain amount can be suppressed to 1% or less of the charge amount.

In addition to the seventh tube set of 1 tube 3-7, the eighth tube set of 1 tube 3-8 is provided in anticipation of permitting adjustment of errors in thickness of the frozen layers to be formed. More specifically, unfrozen liquid in the seventh tube set 3-7 can also be transferred to the eighth tube set 3-8. In this case, the amount of liquid to be transferred to the eighth tube set 3-8 is half the volume of one tube and for the amount of product liquid corresponding to the volume of 127.5 tubes, the drainage can be suppressed to an amount corresponding to the volume of 0.5 tube and the effective process factor, that is, dry processed amount/charged amount is 225/266 (99.6%).

An amount of liquid corresponding to $\frac{1}{3}$ of the volume of each tube may be designed for the formation of frozen layer. For example, the total number of tubes being 40 may obviously be sorted into a first set of 27 tubes, a second set of 9 tubes, a third set of 3 tubes and a fourth set of 1 tube and the drain amount can be suppressed to 1/81 of the charged liquid amount. When the above number 40 is added with 81, the total number of tubes being 121 may be sorted into a first set of 81 tubes, a second set of 27 tubes, a third set of 9 tubes, a fourth set of 3 tubes and a fifth set of 1 tube and the drain amount can be suppressed to 1/243 of the charged liquid amount.

In the foregoing description, a change in difference pressure between atmospheric pressure and a change of negative pressure (from $Pa-\rho gH$ to $Pa-\rho gHf$) due to vacuum pump, is used to effect pressure regulation necessary for maintaining a difference pressure corresponding to a liquid column pressure (which changes from $\rho gH$ to $\rho gHf$) between individual tube sets. However, this purpose of maintaining the difference pressure corresponding to the liquid column may also be achieved by using the atmospheric pressure Pa and positive pressure due to compressed gas. Further, the second and third pressure regulation valves 19-2 and 19-3 may use, for selective pressure regulation, the pressure P0 in the upper space 5 in the drying chamber 1 or the atmospheric pressure and the first pressure regulation valve 19-1 may use, for selective pressure regulation, pressure in the range between negative pressure and positive pressure, whereby during the first formation of frozen layer in the first tube set, the pressure P0 in the upper space 5 in the drying chamber 1 is set to be negative pressure and during the second and ensuing formation of frozen layer, only a tube set in which the formation of frozen layer proceeds is maintained at the atmospheric pressure, the remaining tube sets are maintained at the same pressure as that in the upper space 5 in the drying chamber 1, that is, P0 and the upper space 5 in the drying chamber 1 is maintained at positive pressure.

Also, in the foregoing, over the overall period for the formation of frozen layer in a tube set, the liquid level in the remaining tube sets to be vacant is so set as to be nearly flush with the surface of the lower plate 6. Not only the inner circumferential surface of the tube 3 but also the surface of the lower plate 6 acts as the refrigerating/heating surface 2 and therefore the frozen layer grows on the surface of the lower plate 6 over the overall period for the formation of frozen layer. Since the lower plate 6 opposes through the lower space 7 the bottom lid 17 which is not refrigerated and differs in temperature condition from the internal portion, the frozen layer formed on the surface of the lower plate 6 is not always thicker than the frozen layer formed on the inner circumferential surface of each tube. However, in accordance with conditions of the apparatus, it happens that the frozen layer on the surface of the lower plate 6 grows over the overall period for the formation of frozen layer to have an excessively large thickness. To cope with this problem, according to the invention, the lower ends of the second and third tube sets are so designed as to extend downwards beyond the lower surface of the lower plate 6, whereby during the first refrigeration in the first tube set, the lower liquid level is flush with the surface of the lower plate 6 to form a frozen layer of a predetermined thickness on the lower plate 6, during refrigeration in the second tube set, the lower liquid level is flush with the lower end of the second tube set and during refrigeration in the third tube set, the lower liquid level is further decreased to the lower end of the third tube set. In this manner, the frozen layer on the surface of the lower plate 6 is separated from the unfrozen liquid in the lower space 7 so as to be prevented from growing excessively and at the same time part of unfrozen liquid in the lower space 7 is sucked into the second and third tube sets to reduce the amount of liquid which ultimately remains in the lower space 7 and forms a part of drain.

Further, the bottom lid 17 pivoted with inclination in the foregoing embodiment is advantageous in that unfrozen residual liquid can be discharged easily and liquid supply and discharge can be done at high speed through a liquid supply and discharge conduit of large diameter, thereby permitting minimization of the volume of the lower space 7. This advantage cooperates with the disposition of the sets of a smaller number of tubes which is close to the liquid supply and discharge conduit and in which the lower end is below that of the tube set which is remote from the liquid supply and discharge conduit, whereby in the sets of a smaller number of tubes to which unfrozen residual liquid is sequentially transferred, the lower liquid level in a tube set not receiving liquid can be lower than that in a tube set receiving liquid, to ensure that the frozen layer on the surface of the lower plate 6 can be prevented from growing excessively and at the same time unfrozen residual liquid in the lower space 7 is sequentially sucked into the succeeding tube set to reduce the ultimate drain amount.

If the above procedure is carried out without resort to U.S. Pat. No. 4,802,286, part of dried product or at least remnants adhere to the refrigerating/heating surface 2. Therefore, it is preferable to make use of the present invention to form an ice film on the refrigerating/heating surface 2 and thereafter form a frozen layer of product liquid. However, with the apparatus for mass production practicing the present invention, the drain amount for product liquid charged into the drying chamber 1 can be as small as 1% or less of the charged amount and almost all of the product liquid can be processed through one cycle of process to reduce the amount of adhering remnants in contrast to the conventional apparatus which requires repetition of cycles of process to treat product liquid. Accordingly, in some applications, the small amount of adhering remnants can be removed in washing process conducted after completion of the product process.

Figure 11:
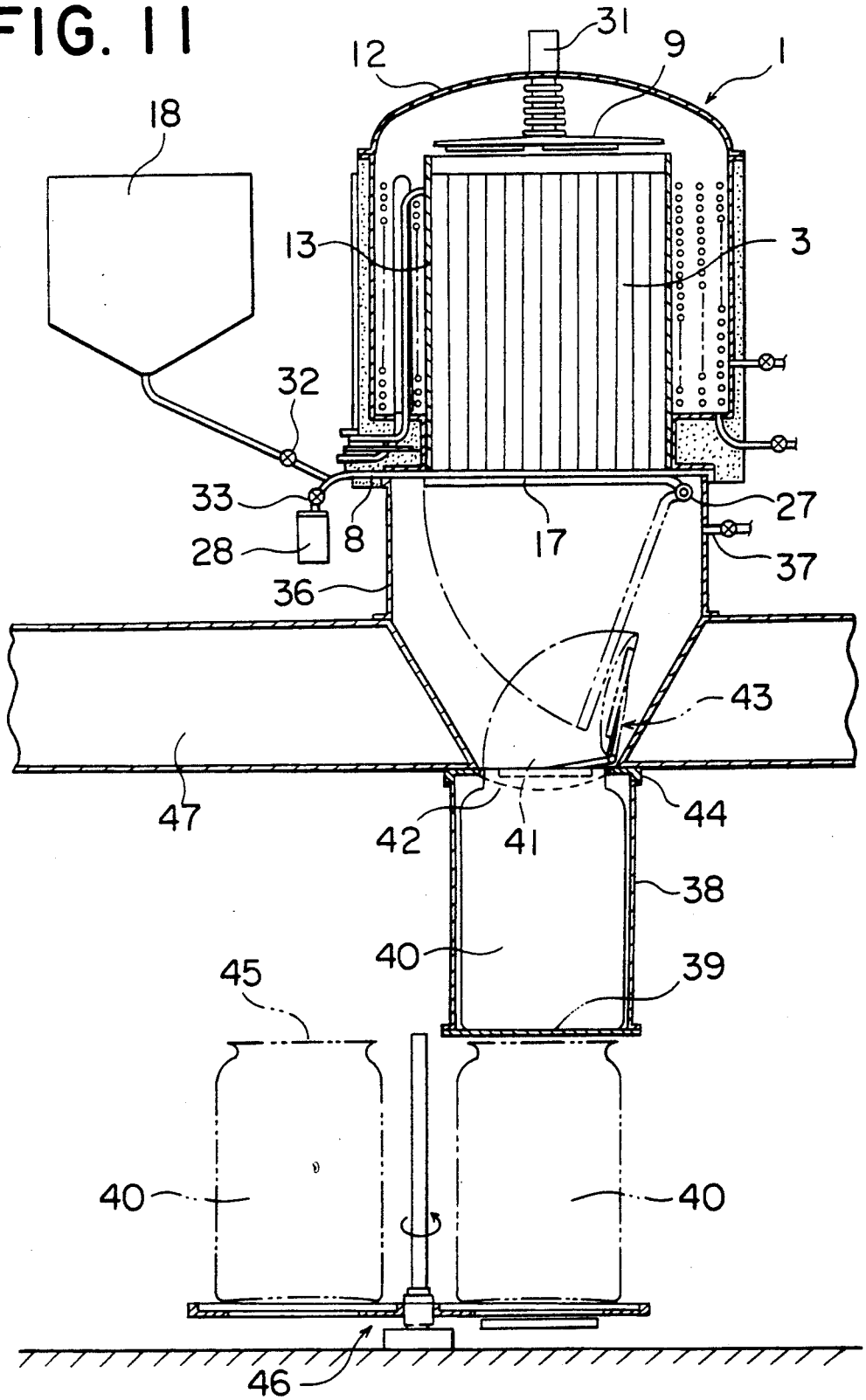
FIG. 11 is a schematic diagram illustrating an arrangement in which a freeze drying apparatus of the invention is mounted to a product collecting equipment.

FIG. 11 is a schematic diagram useful to explain how the apparatus of the present invention is installed in a practical product collecting equipment. As shown, the apparatus according to the invention is mounted on a airtight, pressure-tight, funnel-like hopper 36. The bottom lid 17 of this apparatus is mounted on the pivot 27 which extends through the peripheral wall of the hopper 36 to the outside and is openable inside the hopper. The hopper 36 is connected with a pressure regulation pipe 37 used for regulating pressure prevailing in the hopper 36 and has its opened lower end connected with a cylindrical product container accommodating chamber 38 having its opened lower end connectable to a vertically movable inlet/outlet door 39. In an alternative, the inlet/outlet door 39 may be provided in association with the peripheral wall of the accommodating chamber 38.

A vacant product container 40 is airtightly sealed by means of a container lid 41 with a cock 45. When the product container 40 is received in the product container accommodating chamber 38 through a container inlet/outlet port, it abuts against the upper end of the container accommodating chamber 38 and a container mouth 42 covered with the container lid 41 is correctly fitted in the lower end opening of the hopper 36. A rotary mechanism 43 for moving the container lid 41 is disposed near the lower end of the hopper 36, and its rotary shaft 44 extends through the peripheral wall of the hopper 36 to the outside and is driven by a rotary driver unit disposed exteriorly of the hopper. Below the product container accommodating chamber 38, a product container handling mechanism 46 is installed on the floor. The hopper 36 is supported by, for example, a support arm 47 to fix the equipment.

The arrangement constructed as above is operated as will be described below.

1. Preparation for Operation

Pressure in the vacant product container 40 covered with the container lid 41 is reduced in advance through the cock 45 and the container is steadily airtightly sealed. Such a container is set in the product container accommodating chamber 38 by means of the product container handling mechanism 46 and the inlet/outlet door 39 is closed airtightly. The bottom lid 17 is also closed. Then, a preparatory process for product liquid charging and frozen layer formation is conducted inside the drying chamber 1 in the manner described previously.

2. Formation of Product Frozen layer

An automatic liquid supply valve is opened so that product material liquid for one batch stored in the liquid supply tank 18 is charged into the drying chamber 1 and frozen on the inner circumferential surfaces of all tubes in the manner described previously. Unfrozen part of liquid in the final tube set is discharged into the liquid receiving tank 28 and all of the pressure regulation lids 9 are moved upwards. During this procedure, pressure in the hopper 36 may be increased to a value above the charged liquid column in the drying chamber by admitting clean air or nitrogen gas into the hopper in order to assist the bottom lid 17 in its airtight closure.

3. Freeze Drying Operation

The drying chamber 1, hopper 36 and product container accommodating chamber 38 are evacuated to vacuum and then the heat-transfer medium container 13 is controlled to a temperature for supplying sublimation heat to the frozen layers in the tubes. Thus, the freeze drying operation proceeds. The temperature at the refrigerating/heating surface 2 in the heat-transfer medium container 13 may be controlled in accordance with a predetermined program. Alternatively, the temperature at the refrigerating/heating surface 2 may be feedback controlled in such a way that a temperature sensor suspending radially centrally of the tube so as not to come in contact with the frozen layer is monitored to obtain from the sensor a temperature indication which coincides with a freeze solidification limit temperature. Since the hopper 36 and product container accommodating chamber 38 are evacuated concurrently with evacuation of the drying chamber 1, the role of the bottom lid 17 can be limited to prevention of dropping of the product layer which is dried and peels off from the inner circumferential surface of the tube. Accordingly, the bottom lid 17 does not need vacuum pressure-tight strength and can be reduced in weight. As the evacuation of the hopper 36 and product container accommodating chamber 38 proceeds, the container lid 41 tightly hermetically covering the product container 40 owing to reduced pressure in the product container 40 loses its intimacy to the container 40. Therefore, at a suitable timing within the period for freeze drying operation, the rotary moving mechanism 43 is actuated to catch the container lid 41 and then rotated to move the container lid 41 to a position where the lid 41 does not prevent the product from dropping into the container 40.

4. Collection of Dried Product

In response to a signal representative of completion of the freeze drying operation, the bottom lid 17 is opened slowly so that the dried product in the tube drops into the product container 40 through the hopper 36. The rotary moving mechanism 43 and container lid 41 are shielded by the rotated and opened bottom lid 17 from contact with the dropping dried product. The cylindrical dried product is smashed into small pieces by shocks concomitant with dropping and is received in the product container 40.

Subsequently, the bottom lid 17 is returned to the closure position, pressure in the drying chamber 1, hopper 36 and product container accommodating chamber 38 is returned to a value less than atmospheric pressure (for example, 0.8 atm) by admitting nitrogen gas or clean dried air thereinto, and the rotary moving mechanism 43 is actuated to return the container lid 41 to the product container mouth 42. Thereafter, pressure in the drying chamber 1, hopper 36 and product container accommodating chamber 38 is returned to the atmospheric pressure by admitting nitrogen gas or clean dried air thereinto so that the container lid 41 tightly hermetically closes the product container 40 on account of the pressure difference. If the product in vacuum is desired to be sealed airtightly, the rotary moving mechanism 43 is actuated to return the container lid 41 to the mouth of the vacuum pressure-tight product container while maintaining the hopper 36 at vacuum, and pressure in the drying chamber 1, hopper 36 and product container accommodating chamber 38 is returned to the atmospheric pressure by admitting nitrogen gas or clean dried air thereinto. In this case, the product container accommodating chamber 38 may be omitted and the product container 40 may be received directly in the hopper 36.

Subsequently, the inlet/outlet door 39 is opened and the product container handling mechanism 46 is actuated to convey the product container 40 in the product container accommodating chamber 38 to the outside and transfer it to a conveyor. In continuous operation, the next vacant product container 40 is conveyed into the product container accommodating chamber 38. As necessary, pressure in the container 40 containing the collected product is completely returned to the atmospheric pressure by admitting nitrogen gas or clean air thereinto and then the container is opened.

5. Preparation for the Next Freeze Drying Operation

In the case of continuous operation, a defrosting process for the vapor trap 21 is initiated concurrently with the recovery of the atmospheric pressure to remove ice on the vapor trap 21. If the interior of the arrangement should be cleaned and besides sterilized by clean steam prior to the next operation, no product container is conveyed into the equipment but a cleaning process and a sterilization process follow.

The foregoing description has been given by way of an instance where the dried product is directly collected. If the dried product should be delivered directly to the succeeding production procedure, then the product container 40 is omitted, the product container accommodating chamber 38 acts as a product material tank for the succeeding procedure, and a rotary valve is provided in place of the rotary moving mechanism 43 for product container lid 41.

The present invention has the construction as described previously and the following advantages.

1. Advantages of U.S. Pat. No. 4,802,286 (prior art 5) are absolutely valid for the present invention. In addition, the invention succeed in eliminating disadvantages of the aforementioned US patent. To describe these disadvantages, in the US patent, a substantial amount of product material liquid charged into the freeze drying chamber (several of tens of percent of the material liquid) is not subjected to the freeze drying operation but is discharged from the drying chamber, with the result that this part of liquid must be processed in another freeze drying chamber or relayed to the next batch for continuous treatment. In the latter process, part of liquid supplied to the freeze drying chamber and drained without undergoing freeze drying operation during the initial cycle gradually reduces its percentage in the course of the continuous treatment. However, this part of liquid will mix in the succeeding batches and for this reason, the latter process is hardly applied to materials which would suffer from quality deterioration during the continuous treatment. The latter process is also unsuitable for materials for which the volume of a lot standing for the unit of quality control is small and mixing between lots is not permitted.

The present invention can eliminate the above drawbacks to ensure that most of product liquid supplied into the freeze drying chamber need not experience drainage and is subjected to the freeze drying operation so that the drain amount may be reduced to not greater than 0.5% of the supply amount as necessary. This permits the invention to be applied to materials prone to quality deterioration and materials for which the volume of lot of products is small and mutual mixing between lots is not permitted. The present invention brings about additional advantages that same apparatus need not be used reiteratively and continuously, and that the process of lining an ice film on the inner surface is unneeded in contrast to the prior art patent wherein for light and small materials, remnants of the dried product remain on the inner surface of the tube.

2. When the present invention is applied to a large-scale product which can be processed continuously over a long period of time, a great number of drying chambers with the pressure regulation lid mechanism according to the invention may be provided. But even when the pressure regulation lid mechanism of the present invention is provided for only one of many drying chambers; continuous operation is managed to end at the drying chamber having the pressure regulation lid mechanism of the invention; the present invention is applied to only the final batch; multi-stage frozen layer formation operation is omitted in the other batch operations; liquid is supplied to all tubes at a time; and liquid discharged from all of the tubes is sequentially transferred to the succeeding batch, the amount of liquid which remains unprocessed at the time the operation ends can be minimized.

3. The pressure regulation lid mechanism according to the invention does not at all contact the product liquid. In the prior arts 4 and 5, in order to handle drainage liquid in the next process, the drainage liquid must be received in the liquid receiving tank and thereafter must be pumped up to the liquid supply tank by means of a liquid pump or the like, parts in contact with liquid such as associated piping, valve, containers and liquid pump must be maintained at low temperatures throughout operation, and after completion of operation, washing/sterilization must be conducted. Contrary to this, in the present invention, parts in contact with liquid are only the liquid supply tank 18, liquid charge pipe/valve 32, liquid receiving tank 28 and liquid discharge pipe/valve 33, through which only one passage of liquid occurs merely within a short interval of time, and the interior of the lower space 7 and tube sets 3-1, 3-2 and 3-3 in the drying chamber 1 which are deeply refrigerated naturally by the heat-transfer medium chamber 13. The inner surfaces of the tube sets 3-1, 3-2 and 3-3 and the lower plate 6 of the heat-transfer medium container 13 can be prevented from being adhered with material remnants thanks to the effect of ice film lining (prior art 5 by the present inventors).

Figure 5:
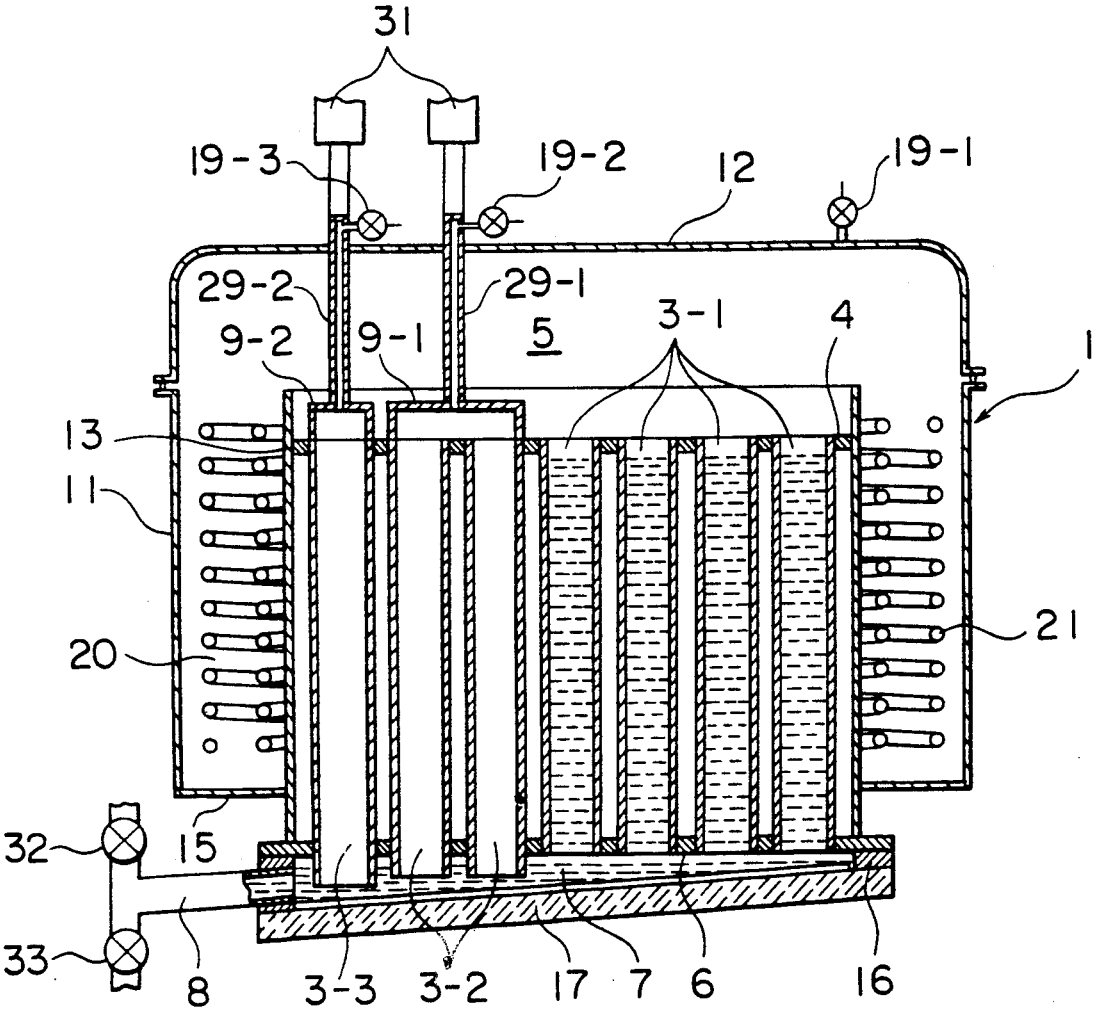
FIG. 5 is a similar sectional view showing the state in which pressure in a drying chamber is reduced under the condition of FIG. 4.

When the product to be handled is immune to quality deterioration for a long period of time at a low temperature of about 0° C. and the production scale through one cycle of continuous operation is far larger than the volume of a single economic drying chamber, only one of the N freeze drying chambers shown in FIG. 5 of the prior art 5 is provided with the apparatus of the present invention and a drying chamber for the first cycle is selected in such an orderly manner that the drying chamber with the apparatus of the invention operates for freeze drying in the final cycle of continuous operation. Then, after all drying chambers are used sequentially and circulatively at an equal time delay by necessary times in accordance with the manner described in connection with FIG. 7 of the prior art 5, the method of the present invention is applied to the final cycle of drying process using the drying chamber with the apparatus of the invention, so that the amount of product liquid which remains unprocessed at the time the continuous operation stops can be reduced to a value which is absolutely negligible as compared to the yield during the continuous operation. When the freeze drying chamber with the apparatus of the invention is operated in its turn in the course of the continuous operation, frozen layers are formed in all tubes simultaneously while keeping the pressure regulation lids moved upwards and part of liquid discharged from all the tubes is transferred to a freeze drying chamber whose turn comes round.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A freeze drying apparatus having: a drying chamber including an upright cylindrical heat-transfer medium container having heat-transfer medium inlet/outlet pipes, a plurality of upright tubes extending through said container from a lower plate to an upper plate, a lower space formed beneath the lower plate of said heat-transfer medium container and being in communication with the interior of said tubes and a product liquid inlet/outlet conduit, an openable bottom lid defining the bottom of said lower space, an upper space formed above said upper plate of said heat transfer medium container and being in communicating with the interior of said tubes, and a trap chamber provided with a pressure regulation valve and being in communication with said upper space, wherein pressure regulation lid means is engageably provided to the upper end of said tubes to airtightly close the upper end, said tubes include one tube set not be covered with said pressure regulation lid means and an other tube set to be covered with said pressure regulation lid means, and a pressure regulation conduit is provided which has a pressure regulation valve adapted to regulate pressure in the other tube set covered with said pressure regulation lid means independently of pressure in said one tube set.

2. A freeze drying apparatus according to claim 1 wherein the other tube set covered with said pressure regulation lid means includes a plurality of tube sets, and the number of tubes in the tube sets is sequentially reduced in substantially geometrical series relationship, beginning with the maximum of said one tube set not covered with said pressure regulation lid means and ending in the minimum of the final stage of said other tube set covered with said pressure regulation lid means.

3. A freeze drying apparatus according to claim 2 wherein said pressure regulation lid means includes independent pressure regulation lids provided in association with respective tubes of said the other tube set covered with said pressure regulation lid means, and said independent pressure regulation lids are respectively connected with pressure regulation conduits provided with pressure regulation valves.

4. A freeze drying apparatus according to claim 3 wherein the lower end of the tube set having the minimum number of tubes is located at the lowermost level, the lower end of the tube set having the maximum number of tubes is located at the uppermost level, and the lower ends of the intermediate tube sets are located at levels which gradually rise from the lowermost level to the uppermost level.

5. A freeze drying apparatus according to claim 3 wherein, in addition to the tubes of the individual tube sets, one or more preparatory tube is provided in said drying chamber, said preparatory tube being prevented from being charged with unfrozen liquid before formation of frozen layers in the tube set having the minimum number of tubes is initiated.

6. A freeze drying method for use in a freeze drying apparatus having: a drying chamber including an upright cylindrical heat-transfer medium container having heat-transfer medium inlet/outlet pipes, a plurality of upright tubes extending through said container from a lower plate to an upper plate, a lower space formed beneath the lower plate of said heat-transfer medium container and being in communication with the interior of said tubes and a product liquid inlet/outlet conduit, an openable bottom lid defining the bottom of said lower space, an upper space formed above said upper plate of said heat-transfer medium container and being in communication with the interior of said tubes, and a trap chamber provided with a pressure regulation valve and being in communication with said upper space, said method comprising the sets of:

sorting said tubes into tube sets of desired numbers of tubes;

airtightly closing the upper end of a tube set with pressure regulation lid means and supplying a material liquid to be dried from the lower ends of all tubes;

increasing pressure in tubes of said tube set closed airtightly with said pressure regulation lid means or reducing pressure in tubes of a tube set not closed airtightly with said pressure regulation lid means to admit the material liquid to be dried into the tubes of said tube set not closed airtightly and to said lower space;

under this condition, refrigerating the tube surfaces to form frozen layers of the material liquid to be dried on the inner surfaces of the tubes to a desired thickness;

reducing pressure in tubes of said tube set closed airtightly or increasing pressure in tubes of said tube set not closed airtightly to admit unfrozen part of the material liquid to be dried into the tubes of said tube set closed airtightly and to said lower space;

under this condition, refrigerating the tube surfaces to form frozen layers of the material liquid to be dried on the inner surfaces of the tubes to a desired thickness;

discharging unfrozen part of the material liquid to be dried from said drying chamber; and thereafter separating said pressure regulation lid means from the upper end of said tube set, evacuating said drying chamber to vacuum and drying all the frozen layers.

7. A freeze drying method according to claim 6 wherein the tubes include a plurality of tube sets, the number of tubes in the tube sets being sequentially reduced in substantially geometrical series relationship;

determining the amount of material liquid to be dried such that the material liquid to be dried substantially fills the interior of tubes of a tube set having the maximum number of tubes and said lower space of said drying chamber;

admitting the thus determined amount of material liquid into the tubes of the tube set having the maximum number of tubes through said lower space of said drying chamber so that frozen layers of the material liquid to be dried may be formed on the inner surfaces of the tubes to a desired thickness and the amount of unfrozen part of material liquid to be dried may be reduced correspondingly;

reducing pressure in tubes of a tube set of the next order to below that in tubes of the other tube sets when the reduced amount of unfrozen part of material liquid to be dried becomes substantially equal to a volume of the tube set of the next order so that the unfrozen part of material liquid to be dried in the tubes of the tube set having the maximum number of tubes may be admitted into the tubes of the tube set of the next order, frozen layers of the material liquid to be dried may be formed on the inner surfaces of the tubes to a desired thickness and the amount of unfrozen part of material liquid to be dried may be reduced correspondingly;

forming frozen layers of material liquid to be dried on the inner surfaces of tubes of a tube set of the order after the next to a desired thickness through a similar operation to that for said tube set of the next order when the reduced amount of unfrozen part of material liquid to be dried becomes substantially equal to a volume of the tube set of the order after the next; and thereafter sequentially applying a similar operation to the above to the remaining tube sets so that formation of frozen layers of material liquid to be dried on the inner surfaces of all of the tubes may be completed.

* * * * *